US012102248B2

(12) United States Patent
Masanek, Jr. et al.

(10) Patent No.: US 12,102,248 B2
(45) Date of Patent: Oct. 1, 2024

(54) MULTIPLE-COMPONENT FLOOR MAT SYSTEM

(71) Applicant: MACNEIL IP LLC, Bolingbrook, IL (US)

(72) Inventors: Frederick W. Masanek, Jr., Barrington, IL (US); Radoslaw Nowak, Wood Dale, IL (US)

(73) Assignee: MACNEIL IP LLC, Bolingbrook, IL (US)

( * ) Notice: Subject to any disclaimer, the term of this patent is extended or adjusted under 35 U.S.C. 154(b) by 200 days.

(21) Appl. No.: 17/838,953

(22) Filed: Jun. 13, 2022

(65) Prior Publication Data

US 2023/0397748 A1 Dec. 14, 2023

(51) Int. Cl.
*E04F 15/02* (2006.01)
*A47G 27/02* (2006.01)

(52) U.S. Cl.
CPC .... *A47G 27/0293* (2013.01); *E04F 15/02044* (2013.01); *E04F 2015/02116* (2013.01)

(58) Field of Classification Search
CPC ..... A47G 27/0293; A47G 27/0231; E04F 15/02044; E04F 2015/02116
See application file for complete search history.

(56) References Cited

U.S. PATENT DOCUMENTS 3,676,971 A * 7/1972 Dombroski ..... E01C 5/001 52/603
3,731,445 A * 5/1973 Hoffmann ..... E04F 15/02 52/471
8,683,769 B2 * 4/2014 Cerny ..... E04F 15/02194 52/584.1
9,062,463 B2 * 6/2015 Chojnowski ..... E01C 5/20
2008/0250744 A1 * 10/2008 Hrovath ..... E04F 15/082 52/582.1

FOREIGN PATENT DOCUMENTS

DE 102009014603 A1 * 9/2010 ..... E04D 11/005
DE 102014107485 B4 * 5/2018 ..... E04F 15/02038
EP 3372749 B1 * 4/2020 ..... E04F 15/02038
FR 2903707 A1 * 1/2008 ..... E01C 5/005
WO WO-2007129211 A2 * 11/2007 ..... E04F 13/088

OTHER PUBLICATIONS

ComfortMat, https://www.weathertech.com/comfortmat/, image of web page, downloaded Apr. 11, 2023.

* cited by examiner

*Primary Examiner* — Adriana Figueroa
(74) *Attorney, Agent, or Firm* — PERKINS IP LAW GROUP LLC; Jefferson Perkins

(57) ABSTRACT

Multiple components of a floor mat system may each be formed of a resilient material such as foamed polyurethane. First and second channels are formed in the respective lower surfaces of first and second mat components, so as to inwardly extend from lateral boundaries thereof. The roofs of the channels are spaced above the general lower surfaces of the mat components. A first socket is formed to upwardly extend from the roof of the first channel, and a second socket is formed to upwardly extend from the roof of a second channel. A connector is used to join the mat components. Posts of the connector are received in the sockets, while a strap joining the posts is received within the first and second channels.

10 Claims, 9 Drawing Sheets

MULTIPLE-COMPONENT FLOOR MAT SYSTEM

BACKGROUND OF THE INVENTION

Persons who stand on hard surfaces at one place for a long time may experience fatigue and injury in their necks, backs, knees, legs and/or feet. Anti-fatigue mats have been provided to ameliorate these issues. These mats can be molded of materials such as foamed polyurethane, typically come as single pieces, and may measure about two feet by three feet. The mats are fairly thick, on the order of 0.75 inch, and have lateral edges that typically are beveled. Their size is often limited by considerations of manufacture, packaging, shipping and ease in deployment by the end user. A need continues to exist for large-area anti-fatigue mats which can be assembled without tools by the end user from multiple components, whose connectors will not be seen or felt by the user, and which, once joined together, will exhibit superior resistance to being separated.

SUMMARY OF THE INVENTION

According to one aspect of the invention, a floor mat system is provided that has at least first and second mat components. An elongate first channel is formed in the first mat component to inwardly extend from a lateral boundary thereof. A first socket is formed in the first mat component to upwardly extend from a roof of the first channel, itself upwardly displaced from a first general lower surface of the first mat component. An elongate second channel is formed in the second mat component to inwardly extend from a lateral boundary thereof. A second socket is formed in the second mat component to upwardly extend from a roof of the second channel, itself upwardly displaced from a second general lower surface of the second mat component. The lateral boundaries of the first and second mat components may be abutted, such that the first and second channels are made to be continuous with each other, and then joined with a connector. The connector has an elongate strap that is adapted to be received into the first and second channels. A first post upwardly extends from the strap and is adapted to be received into the first socket. A second post upwardly extends from the strap and is adapted to be received into the second socket. Once the first post is received in the first socket and the second post is received in the second socket, the first and second mat components are fastened together.

In one embodiment, the roofs of the channels are upwardly displaced from the general lower surfaces of the mat components by a first depth. The connector strap has a second depth or thickness, measured between the strap's upper and lower surfaces, that is less than the first depth. In use, the lower surface of the strap is disposed above the general lower surfaces of the first and second mat components. This will ensure that the connector strap, which can be formed of a relatively hard plastic, does not mar the floor on which the first and second mat components are resting.

In one embodiment, the connector has four posts, positioned at the corners of a quadrangle, wherein each of the posts is connected to neighboring posts by respective straps. The first mat component has a third socket, connected to the first socket by a third channel, and communicating to the lateral boundary of the first mat component by a fourth channel. Likewise, the second mat component has a fourth socket, connected to the second socket by a fifth channel, and communicating to the lateral boundary of the second mat component by a sixth channel. All of the channels have roofs that are upwardly displaced from the general lower surfaces of the first and second mat components. When the first and second mat components are abutted together, the fourth and sixth channels become continuous with each other. Posts of the connector are received in respective sockets in the mat components, and the respective straps of the connector are received in the respective connecting channels. Two of the straps will cross the lateral boundaries, and two will reside in respective ones of the third and fifth channels. The cross-straps provide additional resistance to a tensile force tending to separate the first and second mat components from each other, while the straps positioned in parallel to the first and second lateral boundaries provide additional resistance to shear forces.

In one embodiment, the mat components are made of a resilient material, such as a foamed elastomer. The posts of the connector have shafts with a first diameter, and free ends with a larger, second diameter. The free ends of the posts therefore engage the sidewalls of the sockets with an interference fit. In one embodiment, the free ends of the posts are barbed, such that the force necessary to withdraw them from the sockets is greater than the force necessary to insert them. This also causes the connector straps to be lifted into the channels so that they don't contact the floor.

In an alternative embodiment, the sockets have cylindrical sidewalls. But the interference fit of the free ends of the connector posts to these sidewalls keeps them attached anyway. This is particularly the case when the free ends are barbed.

In another aspect of the invention, a modular floor mat includes at least first and second mat components. A first socket is formed in the first mat component to be laterally inwardly spaced from a first lateral boundary of the first mat component. A second socket is formed in the second mat component to be laterally inwardly spaced from a second lateral boundary of the second mat component. The sockets upwardly extend from respective lower surfaces of the mat components. A connector is provided which has an elongate strap, and first and second posts upwardly extending from the strap. The length of the strap is approximately the same as the sum of the lateral distance of the first socket from the first lateral boundary and the lateral distance of the second socket from the second lateral boundary. When the first lateral boundary is abutted against the second lateral boundary, the connector may be used to join the first mat component to the second mat component by inserting the first post into the first socket and inserting the second post into the second socket.

In one embodiment, the modular floor mat further includes a third mat component. The second mat component has a third lateral boundary and the third mat component has a fourth lateral boundary. A third socket is formed in the second mat component to be laterally inwardly spaced from the third lateral boundary. A fourth socket is formed in the third mat component to be laterally inwardly spaced from the fourth lateral boundary. When the third and fourth lateral boundaries are abutted, a connector with a third post, a fourth post and a connecting second strap may be used to join the second mat component to the third mat component.

The relationship of the first, second and third mat components may be linear, such that the second mat component is a middle mat component and the first and third mat components are end mat components. In this case the second and third lateral boundaries may be parallel to and opposed to each other. Alternatively, the second mat component may be a corner mat component. In this case, the second and third lateral boundaries may be disposed at an angle to each other, such as 90 degrees. Mat systems having other configurations are possible.

The present invention permits the assembly of an infinite number of mat components into a single mat. In one embodiment two of the mat components will be end mat components; while the rest will be middle and/or corner mat components.

In another aspect of the invention, a connector is provided to join together mat components into a single mat. The connector has an elongate strap. A first post stands up from the strap and has a top end. The first post has an enlarged diameter near the top end. A second post, spaced from the first post, stands up from the strap and also has an enlarged diameter near its top end.

In one embodiment, the connector further includes a third post spaced from the first and second posts and a fourth post spaced from the first, second and third posts. Straps connect the third post to the second post and the fourth post, and the fourth post to the first post.

In one embodiment, the posts each have a barb near their top ends. In one embodiment, the connector is integrally injection-molded of plastic, and the posts are hollow.

BRIEF DESCRIPTION OF THE DRAWINGS

Further aspects of the invention and their advantages can be discerned in the following detailed description as read in conjunction with the drawings of exemplary embodiments, in which like characters denote like parts and in which.

DETAILED DESCRIPTION

Figures 1A, 1B:
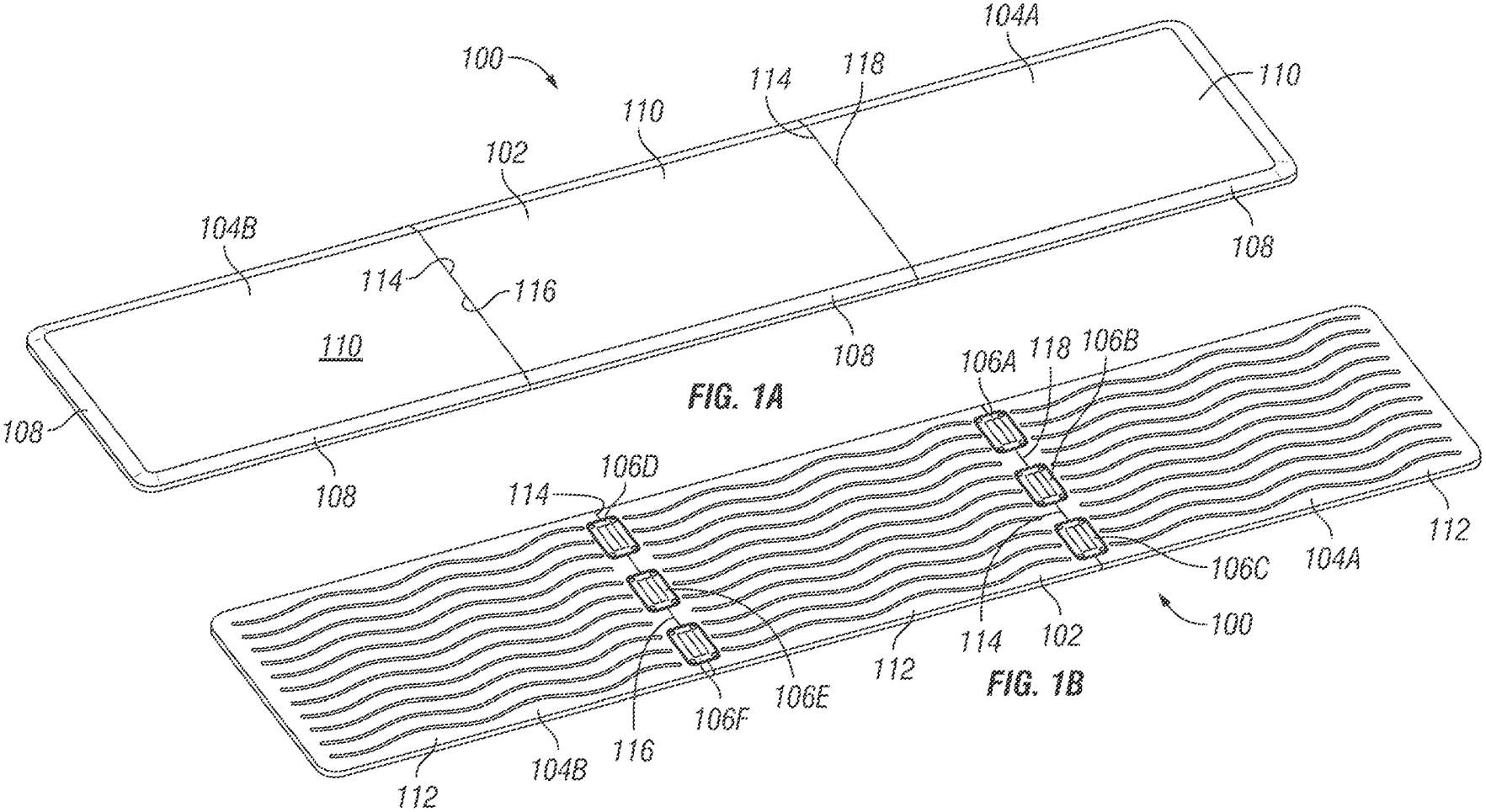
FIG. 1A is a top perspective view of an anti-fatigue mat assembled from a middle mat component and two end mat components.
FIG. 1B is a bottom perspective view of the anti-fatigue mat shown in FIG. 1A.

FIGS. 1A and 1B show a floor mat system or modular floor mat indicated generally at 100. The depicted system 100 is linear and comprises a middle mat component 102 and two end mat components 104A and 104B. Mat components 104A and 104B can be identical to each other. In this illustrated embodiment, six connectors 106A, 106B, 106C, 106D, 106E and 106F are used to fasten mat component 104B to mat component 102 and to fasten mat component 102 to mat component 104B. The connectors 106A-F can be identical to each other.

Figure 2A:
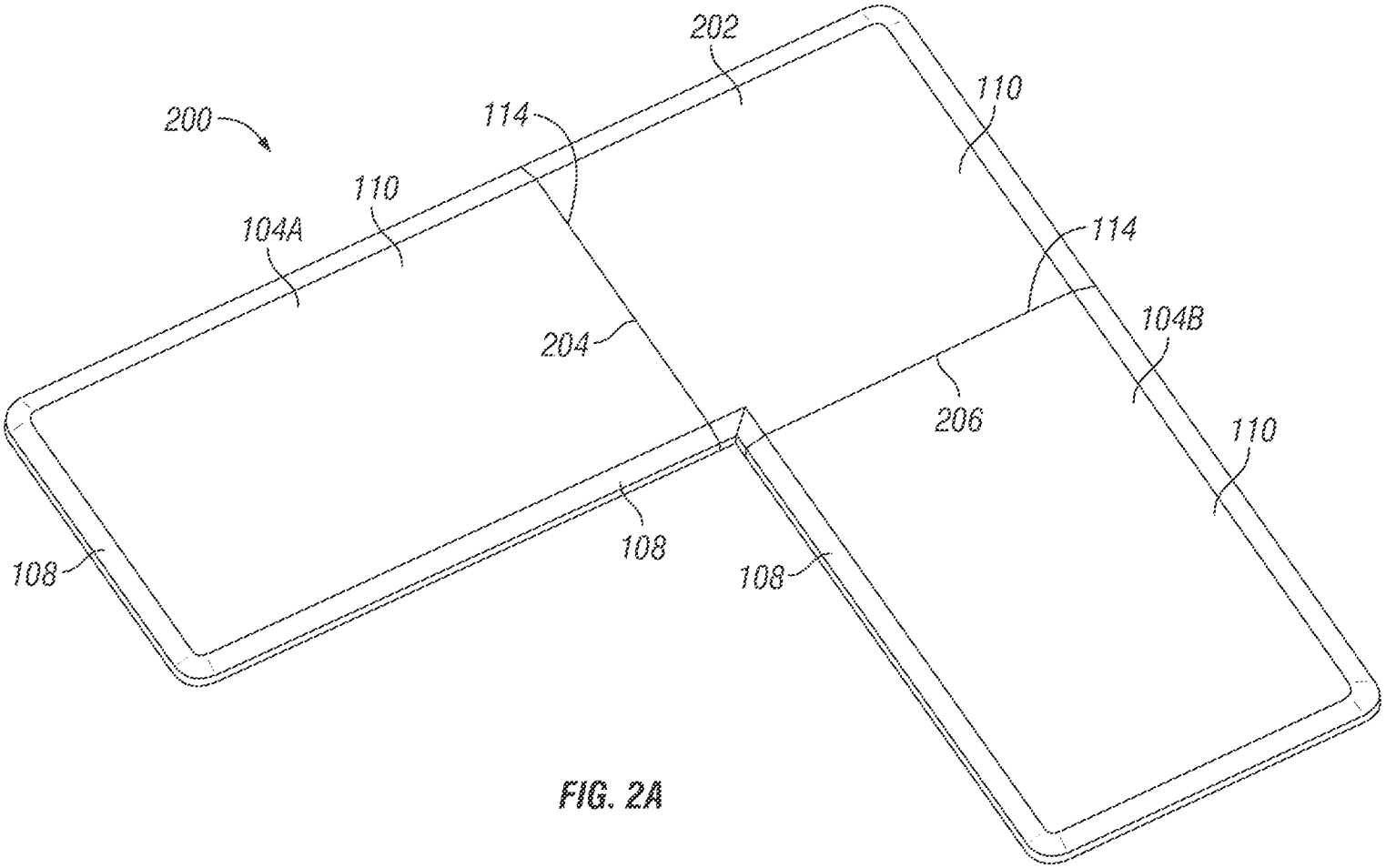
FIG. 2A is a top perspective view of an anti-fatigue mat assembled from two end mad components and a corner mat component.
Figure 2B:
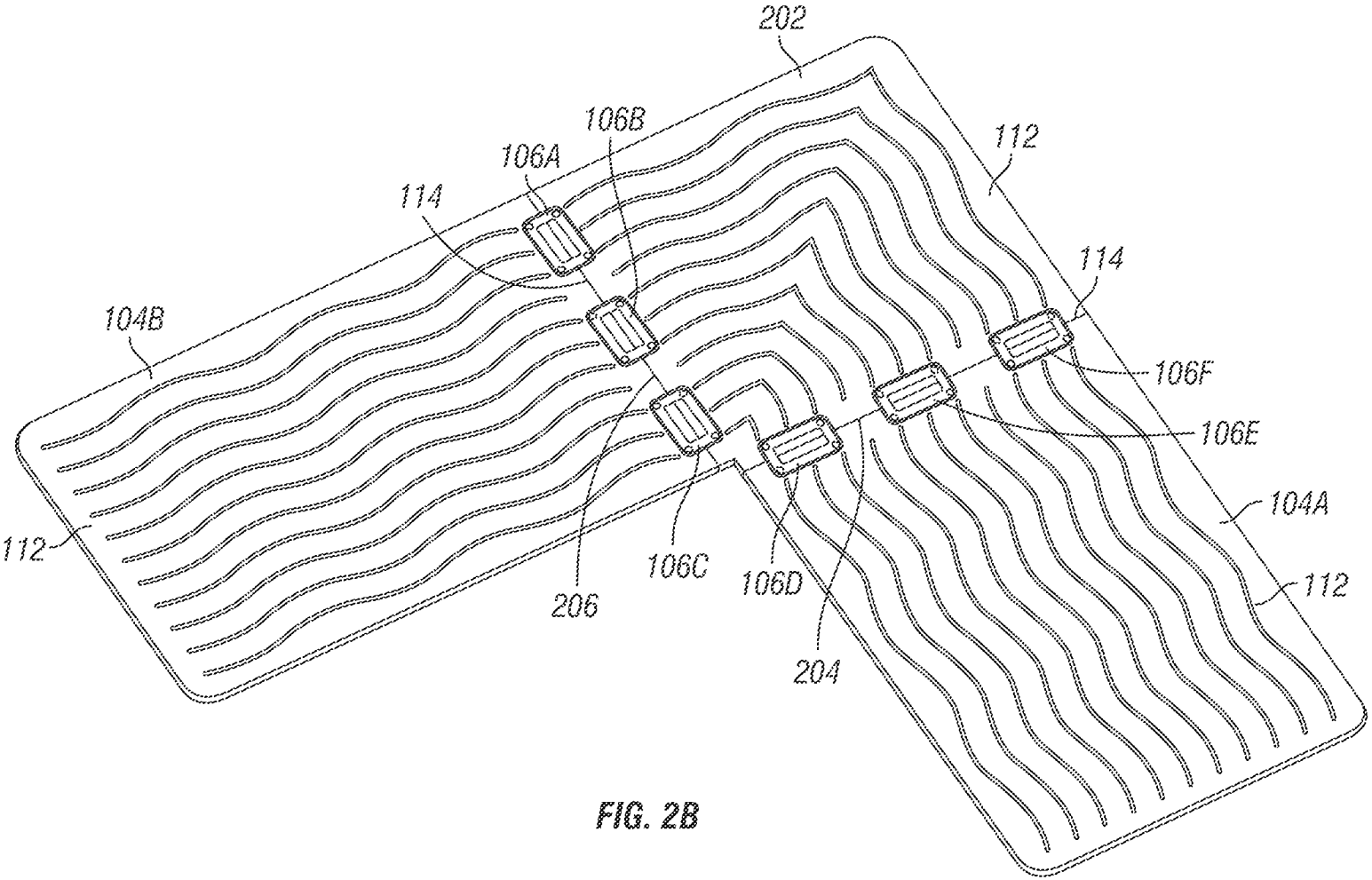
FIG. 2B is a bottom perspective view of the anti-fatigue mat shown in FIG. 2B.

FIGS. 2A and 2B illustrate another possible floor mat system or modular floor mat 200. System 200 is comprised of a corner mat component 202 and, as joined to it along respective lateral boundaries, mat component 104A and mat component 104B. As in modular mat 100, six connectors 106A-F are used to fasten mat component 104B to mat component 202 and to fasten mat component 202 to mat component 104A.

Each of the mat components 102, 104, 202 may be formed of a resilient material such as a foamed elastomer. More particularly, each of the mat components 102, 104, 202 may be cast using a molten foaming polyurethane. After hardening, each of the mat components 102, 104, 202 will have a fluid-impervious flexible skin and a foamed interior.

Each of the mat components 102, 104 and 202 have two kinds of edges or lateral boundaries. For those lateral boundaries not meant to be abutted to the lateral boundaries of adjacent mat components, the lateral boundaries can be beveled edges 108, which help prevent a user tripping over them. Each beveled edge 108 laterally and downwardly extends at an angle from a planar top surface 110 of the mat component to a substantially planar, general bottom surface 112 thereof. As completely assembled, system 100 and system 200 will have overall external lateral boundaries that are all beveled edges 108.

The other kind of lateral boundary possessed by each of the mat components 102, 104, 202 is a lateral boundary meant to abut another lateral boundary. Each end mat component 104 has a single lateral boundary 114. The middle mat component 102 has two opposed lateral boundaries 116 and 118 which, in the illustrated embodiment, are parallel to each other. The corner mat component has mateable lateral boundaries 204 and 206 that are disposed at an angle to each other, such as 90 degrees. Each of these lateral boundaries 114, 116, 118, 204, 206 are adapted to be abutted and mated with one of the remaining lateral boundaries. In the illustrated embodiment, the lateral boundaries 114, 116, 118, 204 and 206 are, apart from a small degree of rounding near their top ends, planar and perpendicular to the top and bottom surfaces of the respective mat component. This makes them easy to put together. But in alternative embodiments, some of the lateral boundaries 114, 116, 204 and 206 could take curved or other nonstraight shapes, and in this instance others of the lateral boundaries would have complementary shapes. For example, lateral boundaries 116, 118 could be convex, and in that instance lateral boundaries 114 would be concave. As other examples, all mating lateral boundaries could be sinusoidal, toothed or interdigitated.

FIGS. 1A, 1B, 2A and 2B illustrate only two of an infinite number of complete mats that can be assembled from the mat components. For example, the linear mat 100 shown in FIGS. 1A and 1B could be further extended by using two or more middle mat components 102 and joining these together. As another example, a mat system could be assembled from four corner mat components 202 and a number of middle mat components 102, to create an endless mat around a work island or station. Mat components 102, 104 and 202 permit the assembly of an antifatigue mat system that is customized to a particular standing work space. In other embodiments, the mat components could be formed as sections of an annulus, such that the assembled system is an endless curved ring. In yet other embodiments, some mat components could be straight, and others curved through an angle of less than ninety degrees, such that a curved and recurved path could be created.

Figure 3:
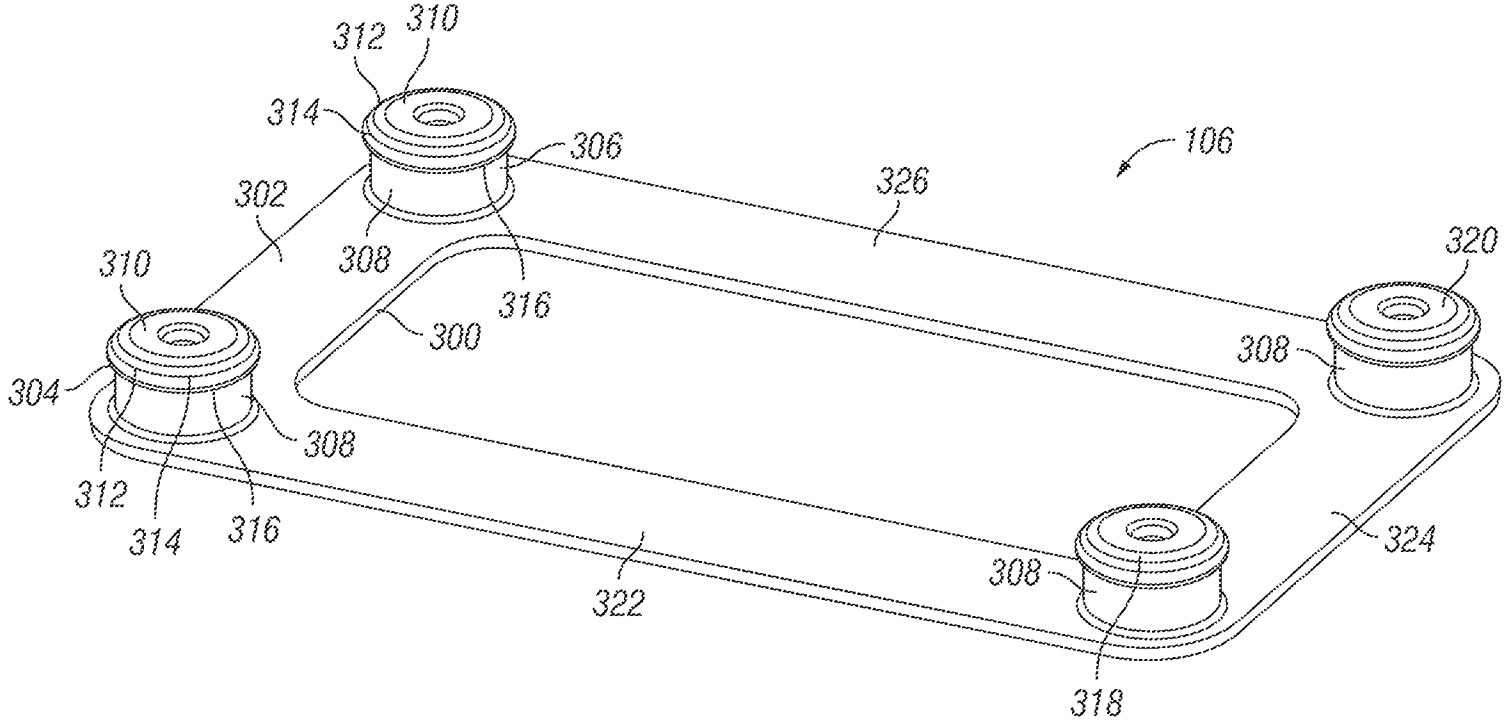
FIG. 3 is a top perspective view of one embodiment of a connector according to the invention.

FIG. 3 illustrates a connector 106, which can be the same as any of connectors 106A-F. Connector 106 at least has a first strap 300 and, upwardly extending from an upper surface 302 of strap 300, a first post 304. In use, the strap 300 is disposed in a horizontal plane and extends from first post 304 to a second post 306, which, like post 304, upwardly extends from the upper strap surface 302. The strap 300 is relatively thin and wide. Post 304 is laterally spaced from post 306 and the posts 304, 306 in the illustrated embodiment are formed around respective vertical and parallel axes.

In the illustrated embodiment, the strap 300 and posts 304, 306 are integrally molded from a plastic such as polypropylene.

The posts 304, 306 each may have a cylindrical shaft 308 and may terminate in an enlarged head 310. In the illustrated embodiment, each head 310 includes a circumferential barb 312 formed by an upper conical surface 314 and a lower horizontal annular surface 316.

In the illustrated embodiment, the connector 106 further has a third post 318 and a fourth post 320, which can be identical in form to first and second posts 304, 306. Post 318 is spaced from posts 304 and 306. Post 320 is spaced from each of posts 304, 306 and 318. The connector 106 in this embodiment has second, third and fourth straps 322, 324 and 326 that are similar in width and thickness to strap 300. Strap 322 connects post 304 to post 318. Strap 324 connects post 318 to post 320. Strap 326 connects post 320 back to post 306. In illustrated embodiment, the posts 304, 306, 320 and 318 form corners of a quadrangle, and straps 300, 326, 324 and 322 form its sides. In use, the straps 326 and 322 each will be spaced from and parallel to a mat component lateral boundary, while straps 300 and 324 will cross two abutting mat component lateral boundaries.

The illustrated connector 106 has four posts, but alternative connectors could have additional pairs of post and additional straps to connect them to the rest of the connector structure. There should be a sufficient number of transverse or cross-straps to resist any tensile force tending to separate the joined mat components from each other. This will vary according to how resistive to tensile forces each mat component is. A relatively soft or delicate mat component may require more cross straps and posts, while a relatively resilient or tough mat component will require fewer. The illustrated four-post connector has been shown to provide enough tensile resistance to prevent the foamed polyurethane mat components from separating from each other under typical tensile loads experienced during their use, such as might be imposed by the feet of the user during walking or running. Meanwhile, the parallel straps 322, 326 offer an enhanced degree of resistance to shear forces operating at right angles to the abutted mat component lateral boundaries.

Figure 4:
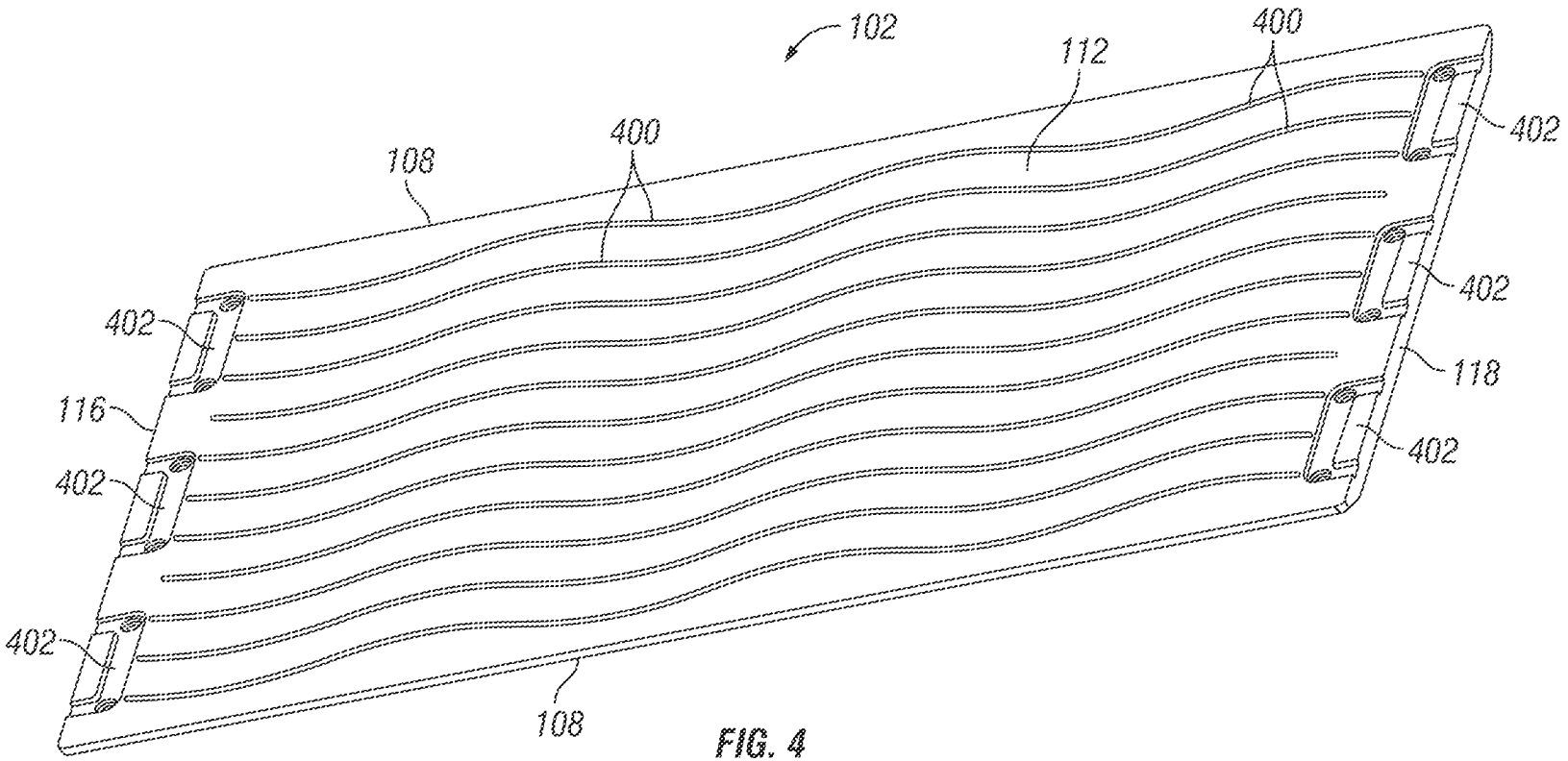
FIG. 4 is a bottom perspective view of a middle mat component prior to assembly into a complete mat.
Figure 5:
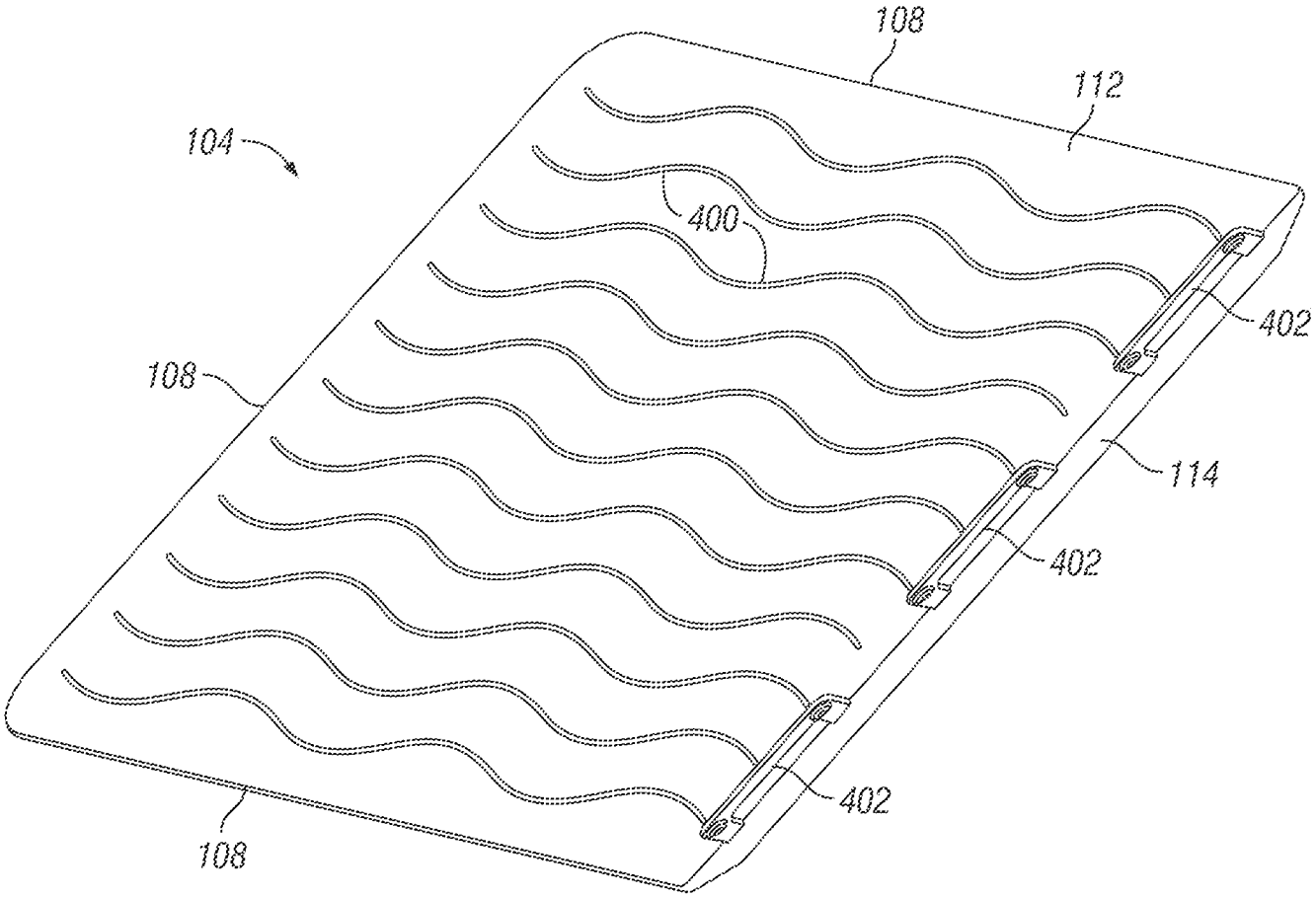
FIG. 5 is a bottom perspective view of an end mat component prior to assembly into a complete mat.
Figure 6:
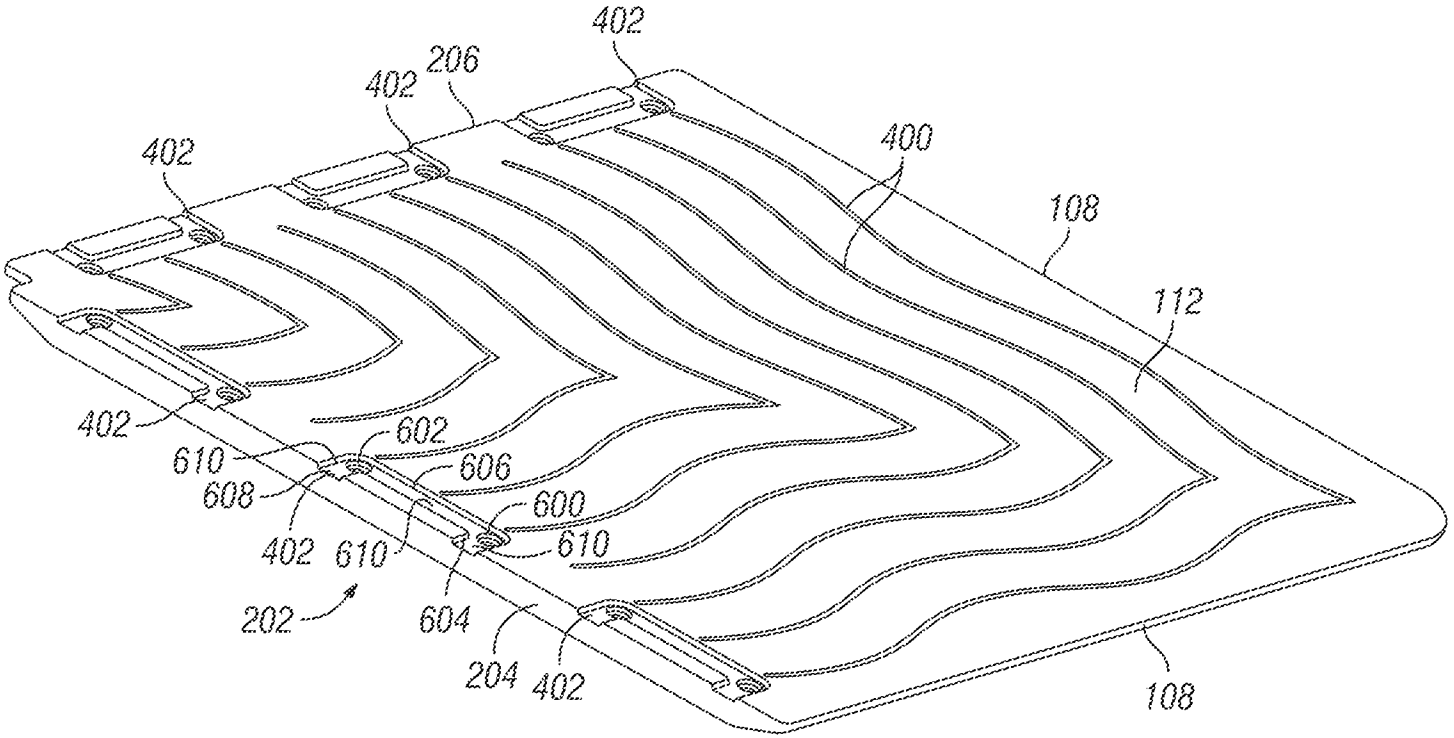
FIG. 6 is a bottom perspective view of a corner mat component prior to assembly into a complete mat.

FIGS. 4, 5 and 6 illustrate the respective bottom surfaces 112 of mat components 102, 104 and 202. Bottom surfaces 112 share many characteristics. Each of them generally resides in a horizontal plane, but may have surface texture to aid in gripping the floor, such as debossed or embossed wavy ribs 400. Each of the mat components 102, 104 and 202 has a plurality of cavities 402 formed adjacent one or more lateral boundaries 116, 118, 114, 204 and 206. In the illustrated embodiment, there are three such cavities 402 per lateral boundary, and they are spaced apart from each other. Each of these cavities 402 is meant to receive one-half of a connector 106, as is seen in FIGS. 1B and 2B. The cavities 402 can be identical in shape to each other, so that any cavity 402 may receive one-half of any of a plurality of connectors 106, which also can be identical to each other.

The structure of one of these cavities 402 will be described in conjunction with FIG. 6. Each cavity 402 has a socket 600 and, spaced from socket 600, a socket 602. A channel 604 extends from lateral boundary 204 laterally inwardly to the location of socket 600. A channel 606, which spaced from and is parallel to lateral boundary 204, extends from the location of socket 600 to socket 602. A channel 608 extends from the location of socket 602 laterally outwardly to lateral boundary 204. Roofs 610 of the channels 604-608 are upwardly (in this bottom view, downwardly) spaced from the general lower surface of 112 of the mat component 202. Each of sockets 600 and 602 opens onto a channel roof 610 and upwardly extends into the mat component interior. The lateral displacement of sockets 600 and 602 from the adjacent lateral boundary is chosen such that enough material of the mat component in question will resist commonly encountered tensile forces urging two abutting mat components apart, and will not tear or fail.

Figure 7:
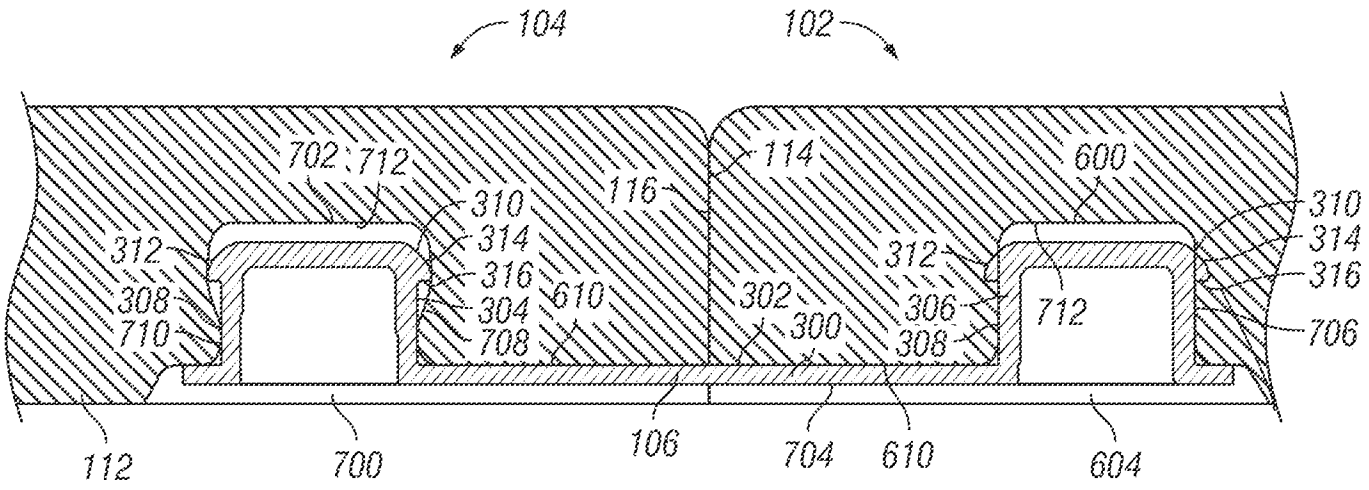
FIG. 7 is a sectional view showing two mat components joined together with a connector, and illustrating two possible alternative embodiments of sockets formed in the mat components.

FIG. 7 is a sectional detail showing a representative two of the mat components 102, 104 abutted together at their lateral boundaries 114, 116. A channel 604 in mat component 102 is lined up with a channel 700 in mat component 104, so that channels 604 and 700 are continuous with each other. The consumer may then install a connector 106 to join together the two mat components. As installed, post 304 is pushed into socket 702, while post 306 is pushed into socket 600. Strap 300 will be received in channels 604 and 700. For this purpose, the length of strap 300 is chosen to be approximately the sum of the lengths of channels 604 and 700.

A vertical distance between the roofs 610 of the channels 604, 700 and the general lower surface 112 is greater than a predetermined depth, or thickness, between the upper surface 302 of strap 300 and a lower surface 704 thereof. In one embodiment, the vertical channel depth can be about 0.10 in., while a thickness between the strap upper surface 302 and the lower strap surface 704 can be 0.05 in. Since at least the enlarged post heads 310 are in an interference fit with the elastomeric sidewalls of sockets 600 and 702, the strap 300 is held against the roofs 610 of channels 604 and 700. This upwardly displaces the lower surface 704 of strap 300 from general lower surface 112, and keeps the lower surface 704 from contacting the floor on which the mat components 102, 104 are resting. This prevents marring the floor by connector 106.

For the purpose of illustration only, the depicted socket 600 has a different shape than socket 702; in an actual commercial application and for ease of manufacture, sockets 600 and 702 would be the same. The socket 600 has a straight vertical cylindrical sidewall 706, the diameter of which may be chosen to be smaller than the diameter of barb 312. Post 306 will therefore be in interference with the sidewall 706, causing the elastomeric material surrounding sidewall 706 to buckle at the locus of contact. This, and the differences in slopes of the surfaces making up barb 312, are enough to pull the connector 106 up off of the floor on which general lower surface 112 is resting. The diameter of barb 312 may be 0.57 in., while the diameter of cylindrical sidewall 706 may be 0.50 in.

Socket 702, on the other hand, has a sidewall 708 with a varying diameter. A diameter across a throat or constriction 710 is less than a diameter taken on the sidewall at a place upwardly spaced from the throat 710. For example, the throat 710 can have a diameter of 0.5 in, while a largest lateral diameter of the socket sidewall can be 0.56 in. Constricted throat 710 will cause an audible snap when the post 304 is inserted into the socket 702, giving an audible signal to the user that this connection has been completed.

Both sockets 600, 702 have a height, as measured from the channel roof 610 to a ceiling 712 thereof, that is larger than the height of any of the posts 304, 306, 318, 320 as measured from the stop surface of the straps 300, 322, 324, 326. This permits a degree of overdrive when installing the connectors 106. For example, the difference in heights can be 0.05 in.

In the illustrated embodiment, all of the sockets are blind, and sufficient mat material overlays them that the posts 300, 322, 324, 326 won't be felt by a person standing on the mat.

Figure 8:
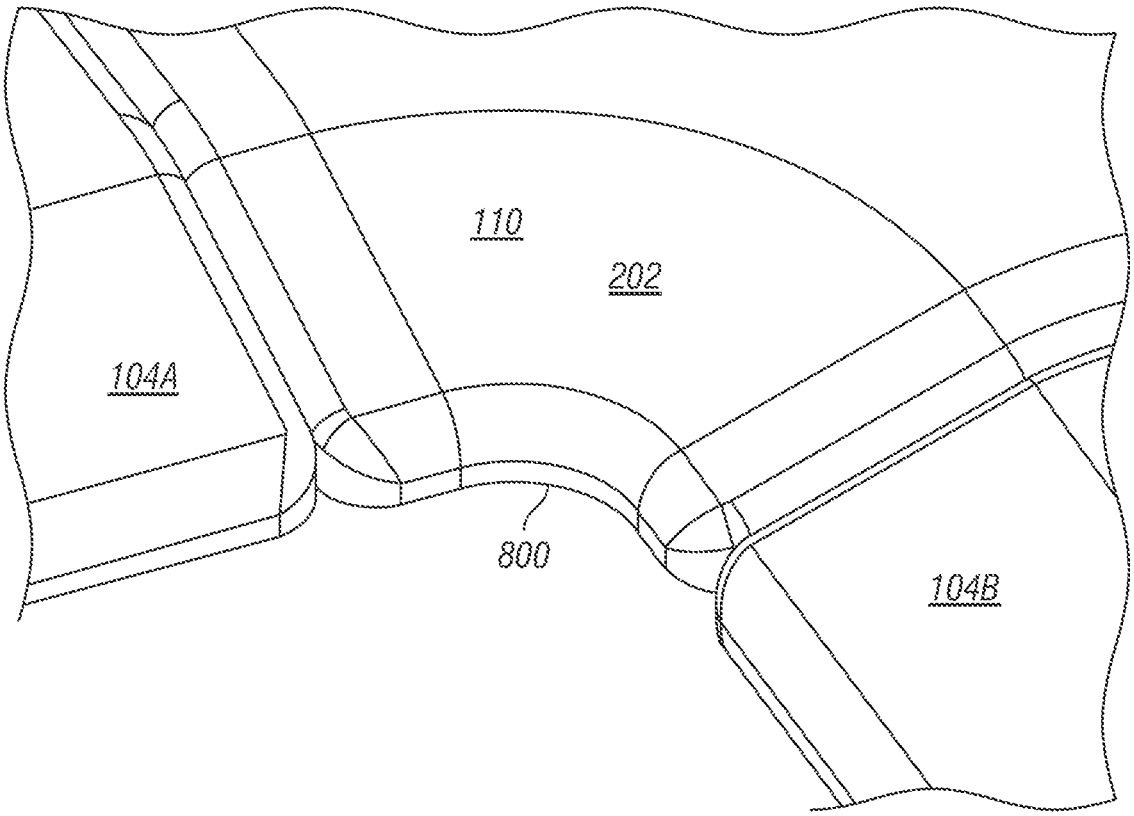
FIG. 8 is a top perspective detail of an alternative corner mat component.

FIG. 8 shows an alternative embodiment of corner mat component 202. In this embodiment, the inner corner 800 is radiused, as shown, instead of presenting a sharp angle. This makes the inner corner of the mat more aesthetically pleasing and easier to clean. The radius of the corner may be about 0.5 in.

In summary, a modular anti-fatigue mat system has been shown and described that permits users to easily assemble anti-fatigue mats that have extended areas and varying overall shapes. Once assembled, the mat components will stay that way and will resist tensile and shear forces tending to separate them. The connectors used to assemble the mat components are hidden from view once the mat is assembled, resulting in a less cluttered appearance and allowing for easier cleaning.

While illustrated embodiments of the present invention have been described and illustrated in the appended drawings, the present invention is not limited thereto but only by the scope and spirit of the appended claims.

We claim:

1. A floor mat system, comprising:

a first mat component having a first lateral boundary and a first general lower surface;

a second mat component having a second lateral boundary and a second general lower surface;

an elongate first channel formed in the first mat component to extend laterally inwardly from the first lateral boundary, the first channel having a roof upwardly displaced from the first general lower surface, a first socket formed in the first mat component to open onto the roof of the first channel and to upwardly extend therefrom;

an elongate second channel formed in the second mat component to extend laterally inwardly from the second lateral boundary, the second channel having a roof upwardly displaced from the second general lower surface, a second socket formed in the second mat component to open onto the roof of the second channel and upwardly extend therefrom; and a connector having a strap with an upper surface, a first post upwardly extending from the upper surface of the strap, a second post laterally spaced from the first post and upwardly extending from the upper surface of the strap;

the first lateral boundary of the first mat component adapted to be abutted against the second lateral boundary of the second mat component such that the first channel becomes continuous with the second channel, the strap adapted to be received into the first and second channels, the first post adapted to be received into the first socket and the second post adapted to be received into the second socket to thereby fasten the first mat component to the second mat component.

2. The floor mat system of claim 1, wherein an elongate third channel is formed in the first mat component, the third channel having a roof that is upwardly displaced from the first general lower surface, a third socket formed in the first mat component to open onto the roof of the third channel and to upwardly extend therefrom, the third socket spaced from the first socket, the third channel spaced from the first lateral boundary of the first mat component and extending from the first socket to the third socket;

an elongate fourth channel formed to extend laterally inwardly from the first lateral boundary of the first mat component to the third socket and to be spaced from the first channel, the fourth channel having a roof that is upwardly spaced from the first general lower surface;

an elongate fifth channel being formed in the second mat component, the fifth channel having a roof that is upwardly displaced from the second general lower surface, a fourth socket formed in the second mat component to open onto the roof of the fifth channel and to upwardly extend therefrom, the fourth socket being spaced from the second socket, the fifth channel spaced from the second lateral boundary and extending from the second socket to the fourth socket;

an elongate sixth channel formed in the second mat component to extend laterally inwardly from the second lateral boundary to the fourth socket, a roof of the sixth channel being upwardly spaced from the second general lower surface; and the connector further comprising a third post adapted to be received into the third socket and a fourth post adapted to be received into the fourth socket, a second strap extending from the first post to the third post and adapted to be received into the third channel, a third strap extending from the third post to the fourth post and adapted to be received into the fourth and sixth channels when the first and second lateral boundaries are abutted to align the fourth and sixth channels, and a fourth strap extending from the second post to the fourth post and adapted to be received in the fifth channel.

3. The floor mat system of claim 2, wherein the roofs of the first, third and fourth channels are upwardly spaced from the first general lower surface by a first depth, the roofs of the second, fifth and sixth channels being upwardly spaced from the second general lower surface by the first depth, each of the straps having an upper surface, a lower surface and a second depth between the upper surface and the lower surface, the second depth of the straps being less than the first depth of the channels.

4. The floor mat system of claim 1, wherein the roof of the first channel is upwardly spaced from the first general lower surface by a first depth, the roof of the second channel being upwardly spaced from the second general lower surface by the first depth, and wherein the strap has a lower surface spaced from the upper surface by a second depth that is less than the first depth, such that in use the lower surface of the strap is disposed above the first and second general lower surfaces.

5. The floor mat system of claim 1, wherein the mat components are made of a resilient material, the first post having a shaft with a first diameter and a free end with a second diameter greater than the first diameter, the second post having a shaft with a third diameter and a free end with a fourth diameter greater than the third diameter, the first and second sockets having sidewalls, the free ends of the first and second posts respectively engaged in an interference fit with the sidewalls of the first and second sockets when the connector is assembled to the first and second mat components.

6. The system of claim 5, wherein the mat components are made of a foamed elastomer.

7. The floor mat of claim 5, wherein the roof of the first channel is upwardly spaced from the first general lower surface by a first depth, the roof of the second channel being upwardly spaced from the second general lower surface by the first depth, the strap having a lower surface that is spaced from the upper surface thereof by a second depth that is less than the first depth, an interference fit of the free end of the first post with the sidewall of the first socket and an interference fit of the free end of the second post with the sidewall of the second socket, in use, causing the lower surface of the strap to be suspended above the first and second general lower surfaces of the respective first and second mat components.

8. The floor mat of claim 5, wherein the free ends of the first and second posts have barbs with beveled top surfaces, such that more force will be needed to pull each post out of a respective socket than will be needed to insert the post into the respective socket.

9. The floor mat of claim 5, wherein each socket has a cylindrical sidewall.

10. The floor mat of claim 5, wherein a fifth diameter of the first socket is taken near the roof of the first channel and a sixth diameter of the first socket is taken at a point remote from the roof of the first channel, the sixth diameter being greater than the fifth diameter, a seventh diameter of the second socket being taken near the roof of the second channel and an eighth diameter of the second socket being taken at a point remote from the roof of the second channel, the eighth diameter being greater than the seventh diameter.

* * * * *